US005941345A

United States Patent [19]

D'Alessio et al.

[11] Patent Number: 5,941,345

[45] Date of Patent: Aug. 24, 1999

[54] SCAFFOLD CROSS MEMBER AND MODULAR SUPPORT ASSEMBLY

[75] Inventors: Michael S. D'Alessio, Flushing, N.Y.; Geoffrey Mules, Nassau Bay, Tex.

[73] Assignee: Harsco Corporation, Camp Hill, Pa.

[21] Appl. No.: 09/057,697

[22] Filed: Apr. 9, 1998

[51] Int. Cl.[6] ..... E04G 1/14

[52] U.S. Cl. ..... 182/179.1; 182/178.1

[58] Field of Search ..... 182/179.1, 178.1, 182/178.5, 186.7, 186.8

[56] References Cited

U.S. PATENT DOCUMENTS

| | | | |
|---|---|---|---|
| 3,190,405 | 6/1965 | Squire | 189/13 |
| 3,420,557 | 1/1969 | Francis | 182/186.8 |
| 4,541,509 | 9/1985 | D'Alessio | 182/186.7 |
| 4,671,382 | 6/1987 | D'Alessio | 182/179.1 |
| 4,858,726 | 8/1989 | Preston | 182/152 |

OTHER PUBLICATIONS

Patent Construction Systems, Harsco Corporation; Modular Frame Scaffold System 1997, pp. 1–8.

*Primary Examiner*—Alvin Chin-Shue
*Attorney, Agent, or Firm*—Eckert, Seamans Cherin & Mellott

[57] ABSTRACT

A cross member which joins two support columns to form an improved scaffold support assembly. The cross member includes an elongated tubular arm having a plate member fixedly attached thereto. The plate member has opposed ends which are slotted such that a joint plate, which is attached at one end to a support column, passes through each slot and is attached at the other end to the cross member.

13 Claims, 5 Drawing Sheets

SCAFFOLD CROSS MEMBER AND MODULAR SUPPORT ASSEMBLY

BACKGROUND OF THE INVENTION

1. Field of the Invention

The invention relates generally to the field of scaffolding, and in particular concerns improved structural designs of scaffold frame construction elements providing improved strength and load capacity in open-frame scaffold systems.

2. Prior Art

Scaffold systems are widespread in industrial, commercial and residential construction settings. Scaffolds generally involve elements that must be compact and light in weight to be carried while climbing, but that assemble into robust structures that vary in size and shape. Conventional scaffold systems are made from a plurality of modular support assemblies coupled by horizontal and diagonal cross-braces to create scaffold frames. Scaffold planks are secured on horizontal members of these frames and provide a platform on which workers and tools can be supported.

Scaffold systems typically are erected as freestanding structures along and beside objects upon which work is to be performed. Scaffold structures are also commonly used for shoring, i.e., supporting a weight. They must be rigid enough to safely support heavy loads including workers, equipment and other structures, yet be structurally simple in that assembly and disassembly of the structures are easily and quickly achieved.

Conventional scaffold systems use horizontal and diagonal cross-braces on several faces of the scaffolding frame to provide necessary structural rigidity and load bearing capacity. An example of a truss based design of this type is disclosed in U.S. Pat. No. 3,190,405—Squire, wherein a scaffold is made from support assemblies having two horizontally spaced vertical standards coupled by horizontal cross-braces welded between the standards. These support assemblies couple vertically with one another. Pairs of the support assemblies on each level and support assemblies on successive levels are connected by removable cross-bracing extending diagonally between the standards. Diagonal cross bracing is also connected between the corners of individual support assemblies for keeping them rectilinear against the tendency to collapse into the shape of a parallelogram. A horizontal deck is supported on the top of the standards, and one or more similar decks could be placed on the horizontal cross members at any of the levels.

While cross-bracing provides an effective means for stabilizing and strengthening a scaffold system, it presents impediments for contractors attempting to work. Horizontal and diagonal cross-braces, particularly on the side of the scaffold facing a structure, obstruct free access to the structure for workers. Similarly, cross-bracing on the opposite side obstruct access for climbing onto the decks and cross-bracing on individual support assemblies obstructs lateral walkways through the scaffold frame. Thus the cross-bracing, which is needed for structural rigidity, requires workers to maneuver themselves and their equipment awkwardly around cross-brace members when traversing the scaffold.

Cross-braced designs are more difficult to erect and dismantle than systems which are made rigid in a different manner. For example, heavier standards and horizontal members can support a load as well as lighter standards and horizontal members coupled with cross-bracing. Thus, the heavier members can permit better access and open walkways. Rectilinear support assemblies of sufficient strength can avoid the need to install removable cross-braces, a time consuming procedure, and improve efficiency by providing better access and freedom of movement. However, heavy support assemblies likewise present problems in that they must be carried up lower support assemblies and installed when building a scaffold having a plurality of levels.

Attempts have been made to reduce the number of cross-braces used in scaffold systems while maintaining adequate structural rigidity and load capacity. Referring to FIG. 9 herein, labelled as prior art, an example of a scaffold system 200 having a reduced number of cross-brace members is the Modular Frame Scaffold System sold under the tradename SPRINT. This design omits cross-bracing from the work-side face of the scaffold structure and from the scaffold thruways (i.e., through the support assemblies at the ends) to create what can best be characterized as an open-frame system. Short diagonal gussets 230 are provided in each of the upper corners of the modular support assembly, in lieu of obstructive diagonal cross members. A single diagonal brace 215 is coupled between the upper end of one vertical standard of one support assembly and the lower end of the next. Each gusset member is welded to a top horizontal cross member 232 and the adjacent support column 212, creating a moment connection which provides structural rigidity to the frame in a direction toward and away from the structure. The longer diagonal brace 215 in the embodiment shown provides rigidity as to only one of the two support assemblies; however, where more than two support assemblies are used together, further diagonal braces 215 (not shown) support the other support assembly as well.

The SPRINT system employs plank members 205 to transfer horizontal loads from the front or work-side leg of the scaffold to diagonal cross-braces 215 on the rear of the scaffold assembly. This is accomplished by providing a series of hooks 225 at each end of the planks which structurally connect with the top cross members of adjacent support assemblies to provide a rigid connection. Such load bearing planks preferably are installed at every level of the SPRINT scaffold system and compensate for the omitted front diagonal cross-bracing. Thus this open-frame design can be safely built to heights attained by conventional scaffold systems. However the scaffold elements, and in particular the support assemblies, are heavier than those of cross-braced scaffolds as in U.S. Pat. No. 3,190,405—Squire, cited above.

With further reference to FIG. 9, a lower horizontal cross member 110 is provided on the support assembly of the SPRINT scaffold and is welded between paired vertical standards or support columns 212. The lower horizontal member is made substantially from rectangular tubing with tapered ends, as detailed in FIGS. 6–8. Lower cross member 110 is formed from an elongated rectangular tube that is crushed down at the top such that its cross-section resembles a "T" shape having a relatively wide upper surface, part of which is two thicknesses, carried on the remainder of the rectangular tubing, which provides support from below (FIG. 7). The rectangular tubing of the lower cross member is also folded inwardly approaching the ends to create a tapered section at each end of the member (FIG. 8). The tapered section clears the extreme ends of the vertical columns, which protrude and can be swaged such that the lower ends of the vertical columns fit into the upper ends of a similar support assembly, or vice versa, when the scaffold frames are stacked to form plural levels. Alternatively, a connection pin with an enlarged center between oppositely protruding ends can be inserted into column ends of equal diameter that are abutted end to end. The lower cross member also prevents planks 205 from lifting up from the top cross member 232 at any intermediate level of decking, which would disengage hooks 225 from top cross member 232 and result in a loss of structural support.

The SPRINT design addresses the access disadvantages associated with conventional scaffolding systems having numerous removable diagonal braces, but it also introduces new limitations. The minimally braced frame design unavoidably permits more lateral sway in the plane of the frame than one with long diagonal bracing. In fact, the legs of such open frames are considered to behave structurally as if they are longer than they actually are, for example as much as 40% longer. This increased virtual length decreases load carrying capacity of the scaffold system as a practical matter because the load bearing ability of the column varies inversely to the square of its length or virtual length.

Due to the tapered ends of lower cross member 110, the attachment to the support columns must be made at a relatively small weld at each end. The limited size of the area available for welding is such that the connections between lower cross member 110 and columns 212 are not rigid enough to withstand a substantial moment. The lower cross members 110 therefore do not brace columns 212 in a way which might reduce their virtual length. Instead, when the supports are stacked, reliance is placed on the upper cross member 232, braced by short diagonals 230, to hold the lower end of the next upper support assembly.

The top surface of lower member 110 has a plurality of cutouts 220, shown in FIG. 6. These cutouts allow plank members 205 to be installed or removed from the scaffold system without first detaching an upper support frame that holds the planks down vertically. Planks 205 may be pushed laterally until the plank hooks 225 align vertically with the cutouts 220 of the lower cross member, whereupon the hooks drop into engagement with the upper cross member of the next lower level. However, the cutouts in the top surface of lower cross member 110 weaken its cross-section since it is no longer a closed shape and behaves like an open channel. An open channel has a reduced moment carrying capacity as compared to a closed structure.

It would be advantageous if the foregoing drawbacks of a scaffold structure with minimal cross bracing could be resolved, while maintaining its functional benefits and without introducing the drawbacks of removable diagonal bracing. What is needed is an improved support frame with a lower cross member which is more rigidly and durably connected between the support columns such that the virtual length of the support columns is reduced, while providing tapered ends to clear protruding ends of the columns for frame stacking. Furthermore the lower cross member should include the cutouts for plank removal but nevertheless provide the support of a closed shape to maximize moment carrying capacity.

SUMMARY OF THE INVENTION

It is an object of the invention to provide a support assembly for an open-faced scaffold system, namely having minimal removable cross bracing, which limits side sway in a lateral plane of the scaffold frame and substantially improves the load carrying capacity of open-frame scaffold systems as presently known.

It is another object of the invention to provide an improved lower cross member for the support assemblies defining the ends and/or intermediate vertical supports of an open-frame scaffold system, to increase the structural rigidity of the support assemblies and enhance structural load capacities.

It is also an object of the invention to provide a lower cross member having tapered ends such that the vertical standards protrude at their ends to facilitate frame stacking, while providing a robust structural connection with adjacent support columns to reduce virtual column length and enhance column load capacities.

It is another object of the present invention to provide a support assembly with a lower cross member which includes a plurality of cutouts to facilitate the removal of plank members from a scaffold assembly while maintaining a closed shape to provide a significant moment carrying capacity.

These and other objects are accomplished by the cross member of the present invention which joins a pair of support columns to form an improved modular support assembly for a scaffold system.

The cross member is formed by attaching a preformed plate member to an elongated tubular arm that extends only part way along the length of the preformed plate member, namely at the center. The plate member has opposed ends, each of which includes an elongated slot and an end that is shaped to complement the contour of a support column. The plate member may also include a plurality of cutouts to accommodate the hooks of horizontal planking for installation or removal of the planking from an assembled scaffold system incorporating the cross member of the invention. Two stiffeners are disposed in the slots at either end and are attached respectively to the tubular arm, the plate member and one of the support columns. The stiffeners extend diagonally downwardly from the vertical column, where the stiffeners are attached above the plate member, to an end of the tubular arm disposed below the plate member. Preferably, each element of the support assembly is made of steel and all connections are welded.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the appended claims. In the drawings.

DETAILED DESCRIPTION OF THE PREFERRED EMBODIMENTS

Figure 1:
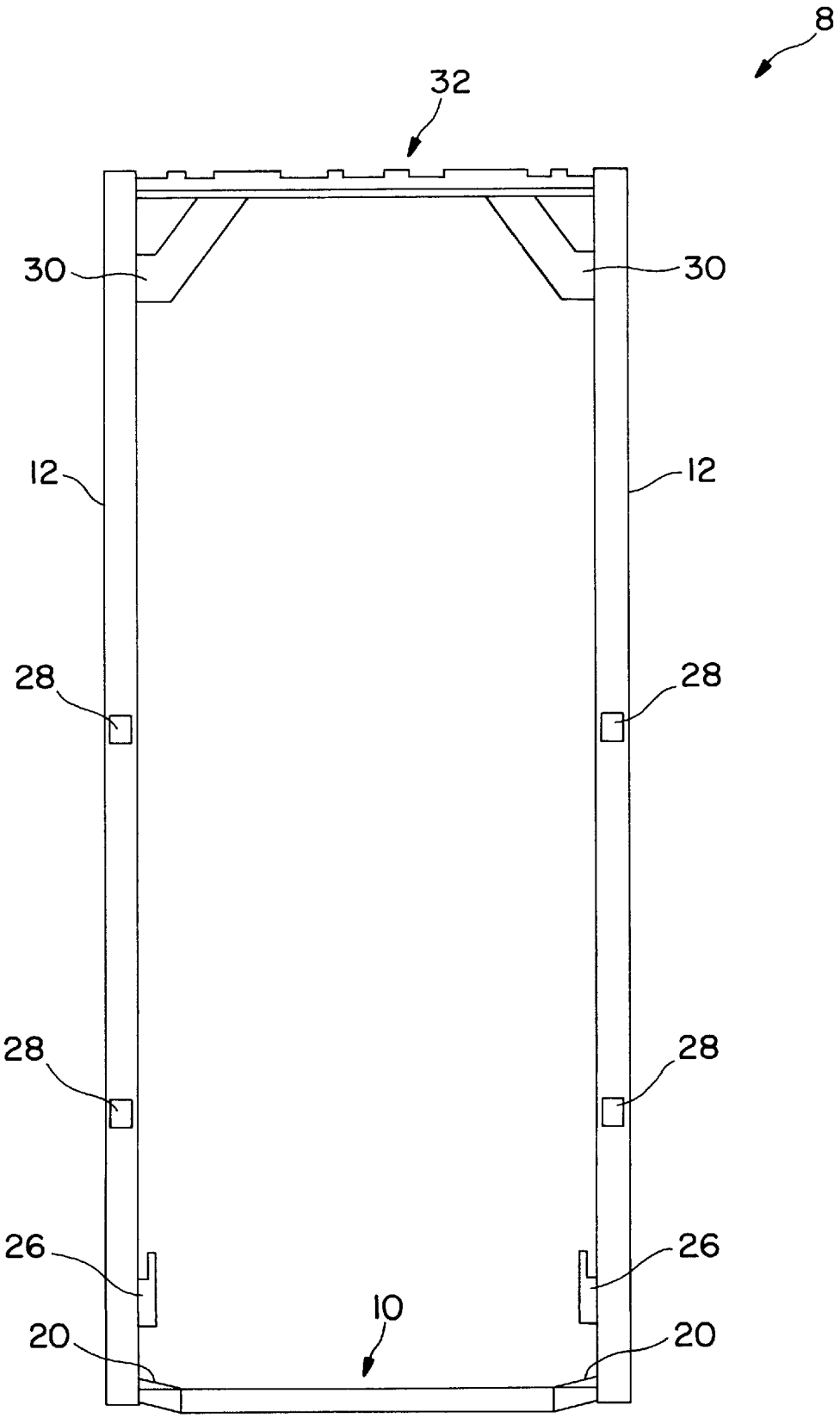
FIG. 1 is an elevation view of a support assembly which incorporates the cross member assembly of the invention.
Figure 2:
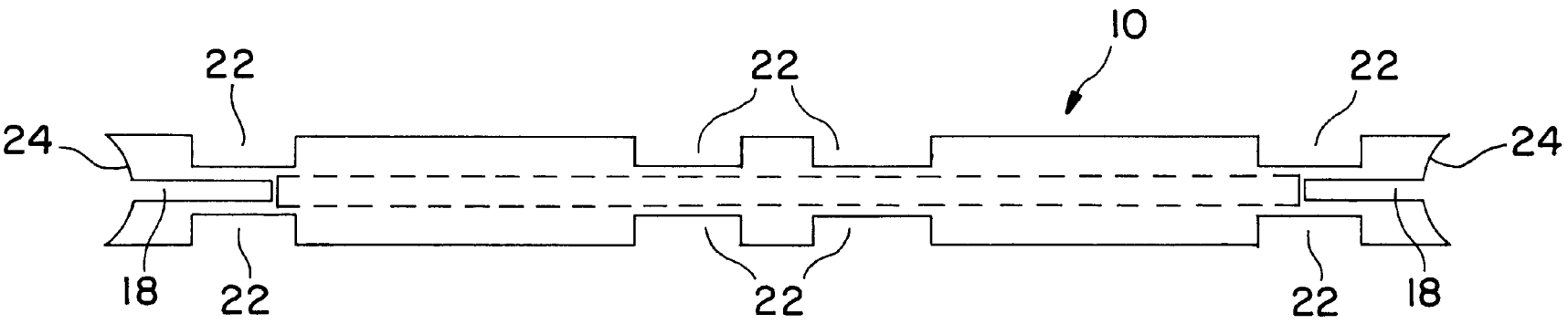
FIG. 2 is a top plan view of the cross member of the invention.

The invention will now be more particularly described with reference to the accompanying drawings wherein similar reference characters designate corresponding elements throughout the several views. FIG. 1 shows a modular support assembly 8 constructed using the cross member 10 according to the invention.

As also shown in more detail in FIGS. 2 through 5, cross member 10 generally includes a plate member 14 which is secured to a tubular arm 16. Plate member 14 is patterned in a predetermined size from a suitably rigid material such as metal or plastic, and preferably comprises plate steel that is punch cut to the desired pattern. The plate member 14 includes a plurality of cutouts 22 of predetermined size. The cutouts are large enough to allow the passage of plank mounting hooks to permit removal of horizontal planking from subjacent scaffold sections that have been stacked on one another.

Elongated slots 18 are provided at each opposite end of plate member 14, each being dimensioned to receive a joint plate 20. The opposite ends of plate member 14 terminate in edges 24 that are shaped to complement the profile of support columns 12, to which they are abutted when assembled.

Tubular arm 16 comprises any suitably rigid material and preferably includes at least a flat upper surface for abutting against and attaching to plate member 14. In a preferred embodiment the tube is square in cross-section. Tubular arm 16 is secured to plate member 14 by any acceptable means known to those skilled in the art including mechanical fastening, welding and gluing. Preferably, tubular arm 16 and plate member 14 are steel and are welded together.

The opposite ends of plate member 14 extend beyond the ends of tubular arm 16. Thus tubular arm 16 does not attach directly to support column 12. A stiffener or joint plate 20 is interposed between the end of tubular arm 16 and support column 12 and is attached, preferably by welding, to each of plate member 14, tubular arm 16 and column 12 at each end of cross member 10. The end of tubular arm 16 is cut vertically and joint plate 20 preferably has a parallelogram shape such that it extends upwardly through the slot in plate member 14 and is attached to column 12 at and above the level of plate member 14. This arrangement is preferred; however the joint plate can comprise other specific geometric shapes such as other polygons or shapes having curved edges.

The parallelogram shape for joint plate 20 is preferred because the ends of the joint plate thereby abut against parallel surfaces at column 12 and the ends of tubular arm 16, as well as extending diagonally to provide triangular blocks that diagonally brace cross member 10 relative to column 12. In addition, ample clearance is provided below plate member 14 for a portion of column 12 to protrude downwardly. This protruding portion can be swaged to fit into the internal diameter of a next lower column of a similar support assembly on which the subject support assembly is stacked. Alternatively, a connection pin (not shown) having mandrels extending in opposite directions from a washer or the like can be inserted into two column ends of equal diameter for joining them together colinearly.

The cross member of the invention provides several advantages over the crushed tube design of the prior art. Attaching plate member 14 to a closed-cross-section arm, preferably of rectangular tubing, rather than forming the upper surface of cross member 10 by deformation of a tube, provides excellent strength against bending. The joint plate 20 forms a durable braced structural connection between tubular arm 16 and column 12 and also between plate member 14 and the column, substantially increasing the area of abutment between cross member 10 and column 12 as well as elongating the area of abutment along column 12. Because the tubular arm does not mount directly to the support column, it is not necessary to cope or shape the end of the tube to conform to the shape of the support column. Unlike the prior art crushed ends, the invention satisfies the clearance function of an end taper by mounting the joint plate in an angular orientation between the cross member and the adjacent support column. Moment carrying capacity of the cross member is not compromised and a increased edge surface is provided which allows a suitably rigid connection to be formed between the cross member and the adjacent support column.

Figure 3:
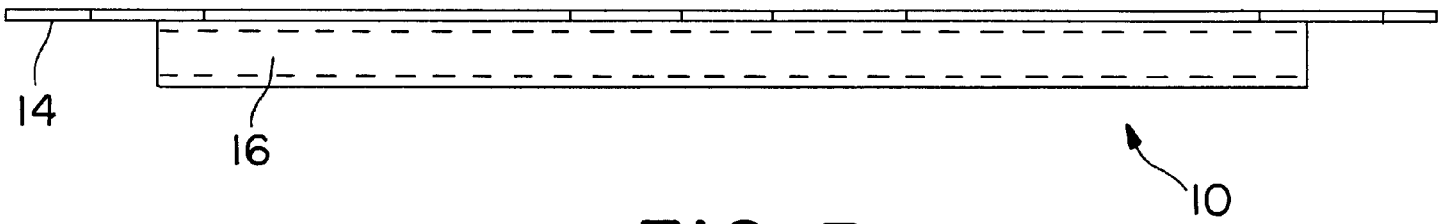
FIG. 3 is an elevation view of the cross member of the invention.
Figure 4:
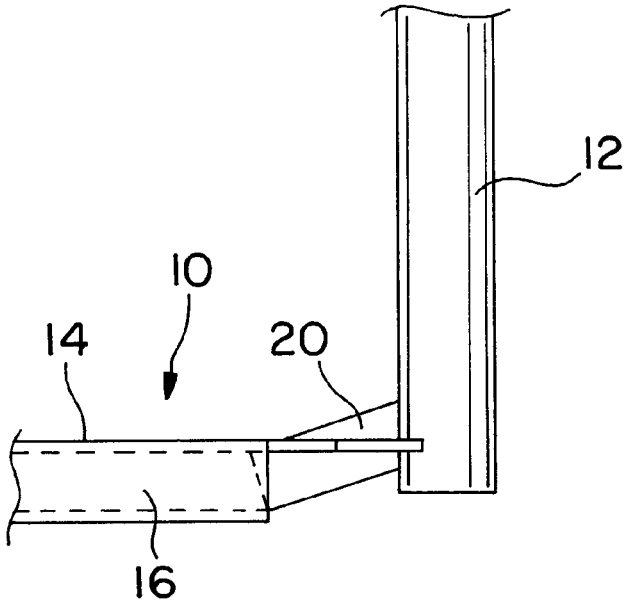
FIG. 4 is a detailed elevation view of the lower right-hand corner of the support assembly of FIG. 1; and, FIG. 5 a partial perspective view of the support assembly incorporating the cross member of the invention, showing one end of the cross member mounted to a support column.
Figure 5:
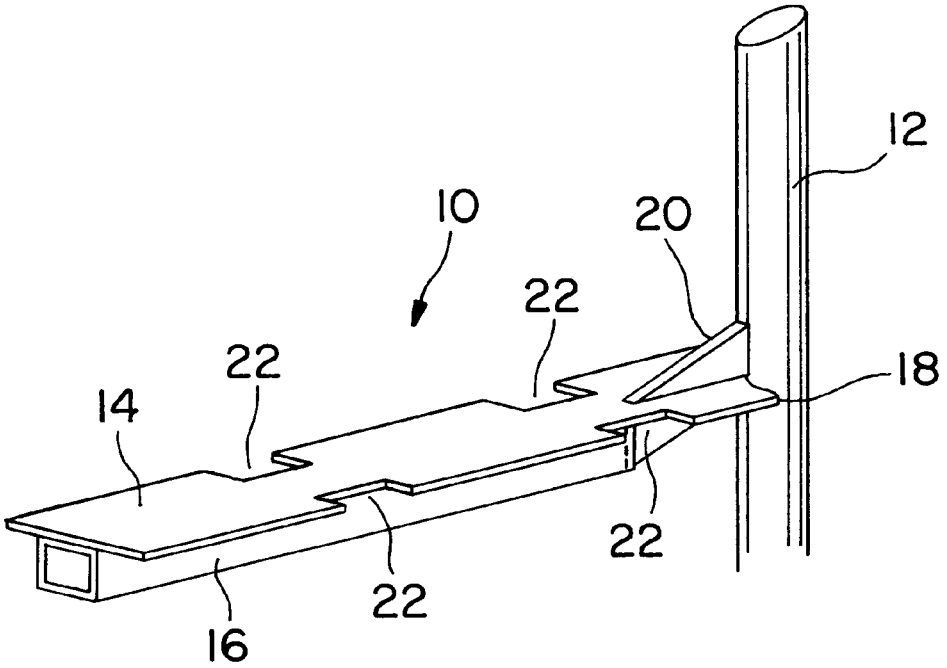
Figure 6:
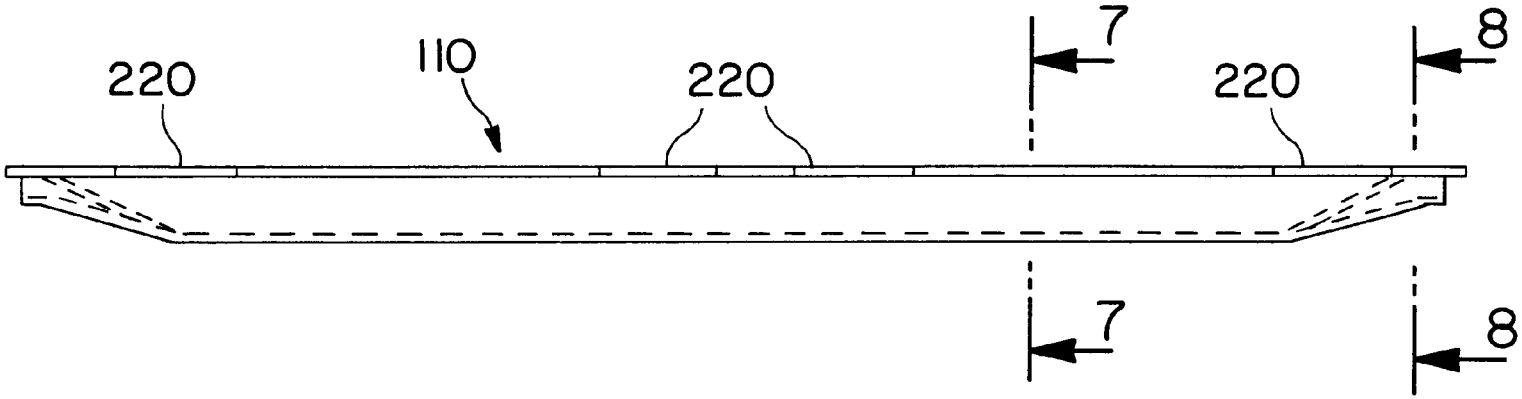
FIG. 6 PRIOR ART
FIG. 6 is a side elevational view of a conventional cross member formed from a crushed tube, labelled as prior art.
Figure 8:
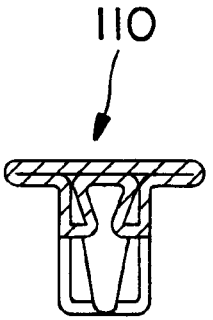
FIG. 8 PRIOR ART
FIG. 8 is a cross-sectional view of the prior art cross member of FIG. 6, taken along line 8—8.
Figure 7:
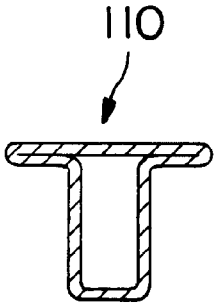
FIG. 7 PRIOR ART
FIG. 7 is a cross-sectional view of the prior art cross member of FIG. 6, taken along line 7—7.
Figure 9:
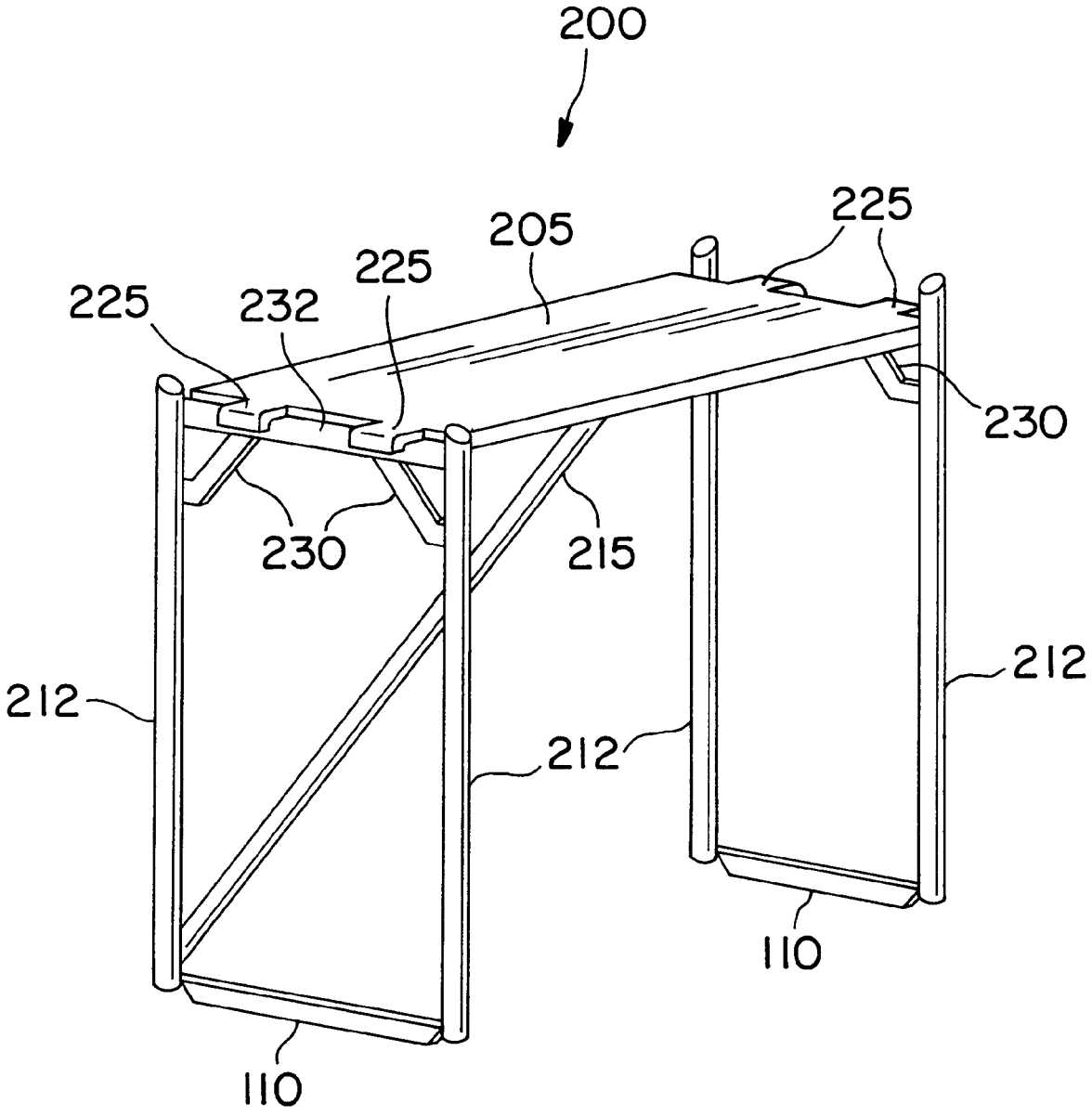
FIG. 9 PRIOR ART
FIG. 9 is a perspective view of the prior art scaffold assembly.

FIGS. 3, 4 and 5 show a detailed view of a section of cross member 10 connected to a support column 12. In this embodiment, plate member 14 is provided with an edge 24 having a radius which matches the cylindrical shape of support column 12. The edge 24 is abutted and secured to support column 12 by application of a weld bead extending the full length of contact between edge 24 and column 12. Before or after that operation, joint plate 20 is inserted through slot 18 at a predetermined angle and position such that one end of joint plate abuts the support column 12 and the opposite end abuts the end of tubular arm 16, at which both connections are welded. Weld beads are additionally applied at the intersection of the joint plate and plate member 14 along the perimeter of slot 18.

Referring again to FIG. 1, where a modular support assembly 8 which incorporates the cross member 10 of the present invention, the support assembly is formed by joining two support columns with top cross member 32 and lower cross member 10. Although the cross member 10 of the present invention is intended for use as a lower cross member, it is recognized that the cross member 10 can similarly function as an top cross member.

With continuing reference to FIG. 1, a top cross member 32 is shown joining support columns 12. Gussets 30 are provided in each of the upper corners of the modular support assembly 8. Each gusset 30 is welded to top cross member 32 and the adjacent support column 12, providing structural rigidity to the frame. Openings 28 may be located at predetermined locations on support columns 12 to receive removable bracing. In another aspect of the present invention, support columns 12 include one or more tabs 26 to facilitate connection of toe boards between successive support assemblies.

In the embodiment of FIG. 1, joint plate 20 is shaped precisely as a parallelogram and is disposed between the parallel surfaces of column 12 and the end of tubular arm 16, which is cut at a right angle. In FIG. 4, an alternative embodiment is shown wherein joint plate 20 is cut at an acute angle on the end abutting column 12 and at a right angle on the opposite end abutting tubular arm 16, which in that case is cut at the corresponding angle to abut joint plate 20.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

We claim:

1. A cross member for attachment between vertical columns of a scaffold assembly, the cross member comprising:

an elongated arm;

a plate member attached along the elongated arm, the plate member having opposite ends extending beyond the elongated arm, each of the ends having an elongated slot leading up to the elongated arm and an edge shaped to complement a contour of the support column; and, a pair of joint plates disposed in the slots, the joint plates being attached to the elongated arm and extending through the slots in the plate member for attachment to the vertical columns.

2. The cross member of claim 1 wherein the cross member, plate member and the joint plates are steel and are welded together.

3. The cross member of claim 1 wherein the elongated arm comprises a tube having a closed rectangular cross section.

4. The cross member of claim 1 wherein the joint plates are inclined upwardly at least on a lower side thereof, whereby the joint plates provide clearance under the plate member at the ends of the plate member.

5. The cross member of claim 4 wherein the joint plates comprise a parallelogram shape for abutting against a right angle cut end of the elongated arm and against the column.

6. The cross member of plate 1 wherein the plate member includes a plurality of cutouts having a predetermined size.

7. A cross member for coupling between columns of a scaffold assembly, comprising:

an elongated arm having a flat upper surface;

a plate member fixed to the upper surface of the elongated arm, the plate member having opposite ends protruding beyond the elongated arm, each of the ends having an elongated slot extending inwardly and an edge shaped to match a contour of the support column; and;

a pair of joint plates having a polygonal shape, disposed in the slots, the joint plates being attached to the elongated arm and extending through the slots in the plate member for attachment to the vertical columns.

8. The cross member of claim 7 wherein the elongated arm comprises a hollow rectangular tube.

9. A support assembly for a scaffold comprising:

a pair of spaced support columns;

an upper cross member rigidly connected at opposite ends thereof between the support columns;

a lower cross member rigidly connected at opposite ends thereof between the support columns, the lower cross member comprising an elongated arm, a plate member attached to the elongated arm and having opposite ends extending beyond the elongated arm, each end having an slot extending inwardly from an edge shaped to complement a contour of the support columns, and a pair of joint plates disposed in the elongated slots and being attached between ends of the elongated arm and the columns.

10. The support assembly of claim 9, wherein the joint plates are inclined upwardly at least on a lower surface thereof.

11. The support assembly of claim 10, wherein the joint plates are shaped substantially as parallelograms extending between parallel surfaces of the elongated arm and the columns.

12. The support assembly of claim 9, wherein the elongated arm is rectangular in cross section.

13. The support assembly of claim 12, wherein the elongated arm comprises a hollow rectangular tube.

* * * * *